United States Patent [19]

Leclerc

[11] 4,106,137

[45] Aug. 15, 1978

[54] SOFA BED

[76] Inventor: Réal Leclerc, 241 St. Vallier St., West, Quebec, Canada, G1R 3B5

[21] Appl. No.: 787,282

[22] Filed: Apr. 13, 1977

[30] Foreign Application Priority Data

Apr. 14, 1976 [GB] United Kingdom ..... 76/15204

[51] Int. Cl.[2] ..... A47C 17/04

[52] U.S. Cl. ..... 5/24; 5/12 R; 5/26 R; 5/43

[58] Field of Search ..... 5/12 R, 24–26, 5/43, 320

[56] References Cited

U.S. PATENT DOCUMENTS

| | | | |
|---|---|---|---|
| 2,534,175 | 12/1950 | Lorenz | 5/43 |
| 3,258,787 | 7/1966 | Emmons et al. | 5/43 |
| 3,329,976 | 7/1967 | Heller | 5/24 |
| 3,872,523 | 3/1975 | Garza | 5/12 R |

FOREIGN PATENT DOCUMENTS

| | | | |
|---|---|---|---|
| 476,353 | 8/1951 | Canada | 5/43 |

*Primary Examiner*—Casmir A. Nunberg

[57] ABSTRACT

A sofa bed wherein the backrest portion is pivoted down to constitute the bed and which is characterized by simple pivot connections positioned at the opposite ends of the backrest-bed unit and allowing readily disconnection of the backrest-bed unit from the base for separate transportation and moving of these sofa components. This sofa-bed includes a base, opposite end and armrest structures, the backrest-bed unit, and a single pivot pin and slot connection between each end of the backrest-bed unit and the corresponding opposite end and backrest structure for readily disconnection of the backrest-bed unit by were sliding of each pivot pin out of the corresponding slot. The backrest-bed unit includes a box-shaped frame construction defining a rectangular cavity in which a spring mattress is mounted, and a flexible sheet cover operatively extending over the mattress and detachably securable to the box-shaped frame construction to hold the blankets against the mattress while the backrest-bed unit is in the sofa configuration position.

4 Claims, 6 Drawing Figures

SOFA BED

This invention relates to a sofa-bed of the type wherein the backrest section is pivotable to the bed configuration position.

The sofa-bed of the above type which has been proposed so far include a complex hinge mechanism to provide the pivoting movement and to assist the pivoting action for easy opening and closing of the backrest section. There resulted so far a relatively heavy sofa-bed due to such hinge mechanism. The transportation or moving of such previous sofa-bed was thus hampered by the substantial weight of such hinge mechanism and also by the fact that the backrest is attached to the base and meant to be transported there with. Besides, such sofa-bed as proposed so far requires removal of the blankets to use it in the sofa configuration position. Furthermore, the backrest-bed portion has so far been heavily framed to provide the required rigidity resulting in a relatively complex and expensive construction.

It is a general object of the present invention to provide a sofa-bed of the above type which uses a very simple hinge mechanism.

It is another general object of the present invention to provide a sofa-bed of the above type wherein the backrest section is simply hinged and is balanced relative to the pivot axis to assist the pivoting action.

It is another object of the present invention to provide a sofa-bed of the above type wherein the backrest section constitutes a backrest-bed unit which is readily detachable from the base for easier packings wrapping, or crating thereof for delivery from the manufacture and for more convenient transportation or moving thereof.

It is still another object of the present invention to provide a sofa-bed of the above type wherein the blankets may conveniently and unconspicuously remain in operative position against the mattress when the sofa-bed is used in sofa configuration position.

It is a further object of the present invention to provide a sofa-bed of the above type wherein the backrest-bed unit or section, in the bed configuration position, is attached to the base and thus prevents accidental tripping of the backrest-bed unit upon the user taking position on the free overhanging rear edge portion thereof.

It is a still further object of the present invention to provide a sofa-bed of the above type wherein the backrest-bed unit or section is of simple and inexpensive box-shaped construction allowing to easily and simply mount a mattress thereon.

The above and other objects and advantages of the present invention will be better understood with reference to the following detailed description of a prefered embodiment thereof which is illustrated by way of example, in the accompanying drawings; in which.

Figure 1:
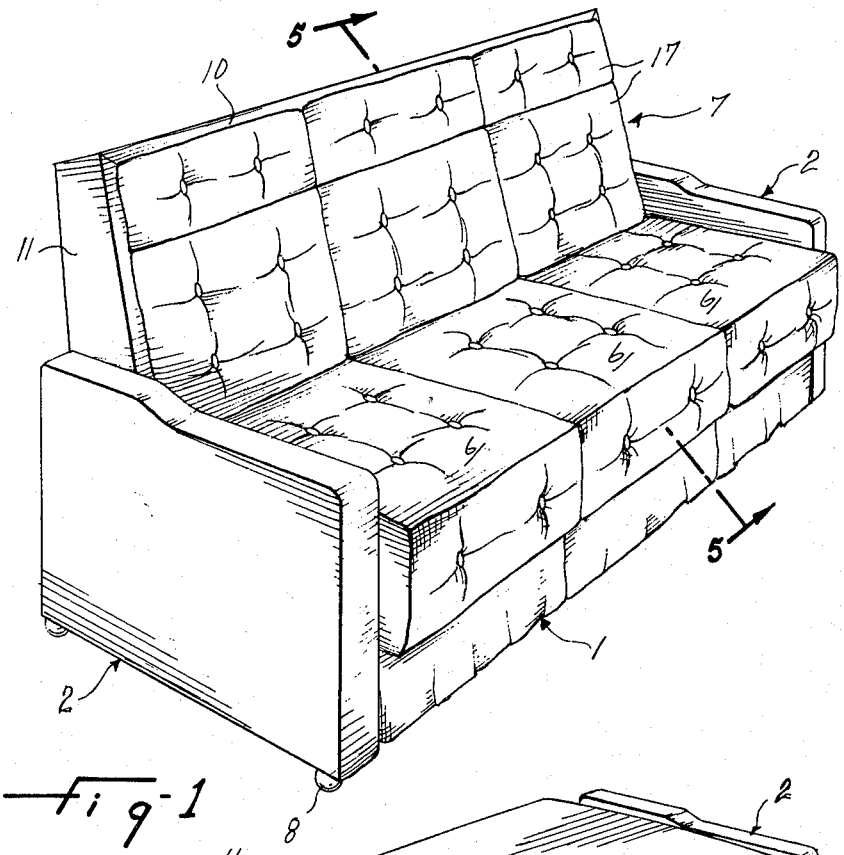
FIG. 1 is a perspective view of a sofa-bed according to the present invention and shown in the sofa configuration position.

The illustrated sofa-bed includes a base 1 rigidly secured at its opposite ends to the opposite end and armrest sections 2. The base 1 includes a pair of longitudinal boards 3 and 4 and a pair of transverse boards 5 one of which being shown in FIG. 5. The boards 3, 4, and 5 form a rigid rectangular frame arranged horizontally and having any appropriate cover to define a top seating portion in combination with foam cushions 6. Each foam cushion is formed with a downward front extension to conceal and cushion the forward edge elements of the horizontal frame of the base. As may be seen in FIG. 5, the rear board 4 is placed at an angle and substantial forward of the rear of the sofa-bed to form an inclined abutment for the back-rest unit 7.

The sofa end and armrest sections 2 are conventionally made to define rigid structures at the opposite ends of the sofa-bed. Each of these opposite end structures are rigidly fixed to the opposite ends of the base to carry the latter off the ground. Each of these opposite end structures also upwardly project relative to the base and is mounted on a pair of casters 8.

Figure 3:
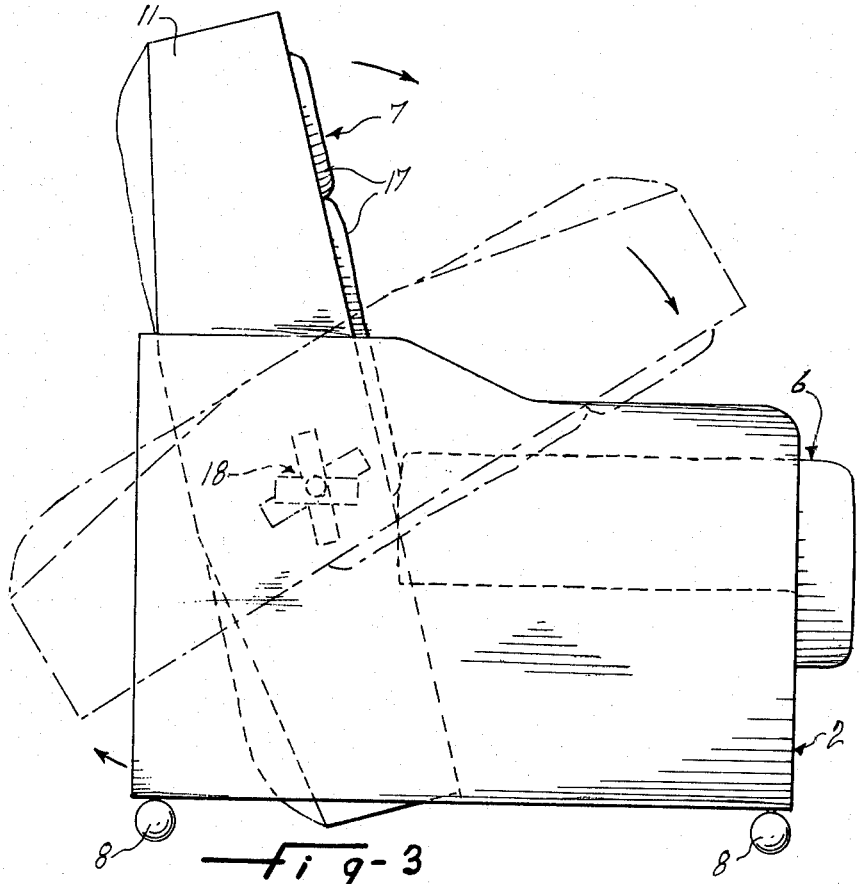
FIG. 3 is an end view of the sofa-bed illustrating the pivoting of the backrest-bed section toward the bed configuration position.

The backrest-bed unit 7 includes a box-shaped peripheral frame construction defined by a pair of longitudinal boards 9 and 10, by a pair of transverse boards 11 at the opposite ends respectively of the boards 9 and 10, and by a rigid panel 12 rigidly fixed to the boards 9, 10 and 11 and defining the bottom of a rectangular cavity. The latter extends within the peripheral; confines of the boards 9, 10 and 11 and faces rearward when the backrest-bed unit 7 is in the sofa configuration position as in FIGS. 1, 3 and 5.

The backrest-bed unit 7 includes a spring mattress 13 fitted in the above mentioned rectangular cavity with a slight clearance around it to tuck in the peripheral edge of the blankets, not shown. The mattress is slightly thicker than the depth of the rectangular cavity and the boards 9, 10 and 11 are cut out such as at 14 and 15 for the comfort of the user of the bed.

A flexible cover sheet 16 of any durable material transversely extends over the rectangular cavity and operatively snaps to the frame construction of the unit 7 to hold the blankets of the bed in extended position against the mattress 13. Paddings 17 is fixed to the rigid panel 12 on the opposite sides thereof relative to the mattress 13 to provide cushions for the back of the one seating on the sofa.

A pair of single-pivot connections 18 pivotally connect the opposite ends of the backrest-bed unit 7 to the opposite end and armrest sections 2 respectively and define a single pivot axis above the base 1. It should be noted that these connections are positioned such that the single pivot axis is inwardly spaced relative to the opposite faces and opposite lateral edges of the backrest-bed unit 7 to balance the latter about the pivot axis. Thus, this balanced pivoting makes it easier to handle the unit 7 between the sofa configuration position and the bed configuration position.

Figure 6:
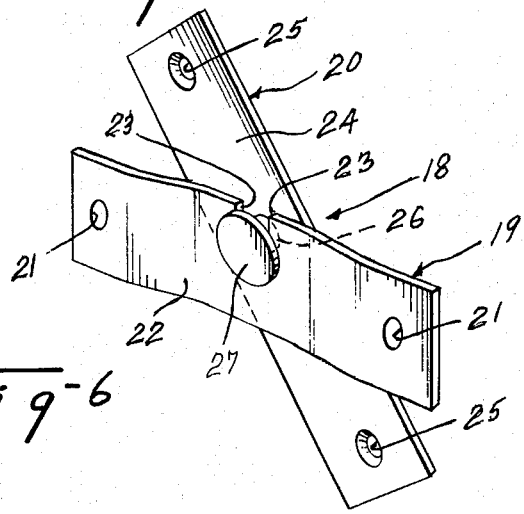
FIG. 6 is a perspective view of one of the two simple pivot connections at the opposite ends respectively of the backrest-bed section.

Each single-pivot connection 18, as best shown in FIG. 6 includes a pair of pivot members 19 and 20. The pivot member 19 constitutes an elongated plate which is secured against the inner face of the corresponding sofa section 2 by screws or bolts through the bores 21. When so fixed, the pivot plate member 19 has an intermediate portion 22 which bulges away from the corresponding end section 2. A slot 23 longitudinally extends downward in the bulging portion 22 from the upper edge of the latter.

The pivot member 20 includes an elongated plate 24 which is fixed against a corresponding end of the backrest-bed unit 7 by screws or bolts through the bores 25 therein. The pivot member 20 includes a projection forming a pivot pin 26 laterally engaging in the pivot recess defined by the corresponding slot 23. The above projection ends into a flat head 27 at the outer end of the pivot pin 26. This flat head slidably engages behind the bulging portion 22 to axially retain the pivot pin 26 in its slot 23. It may readily be understood that the pivot pins 26 and slots 23 allows to readily remove the backrest-bed unit for separate transportation, moving and packing of the two distinct parts of the sofa-bed.

Figure 5:
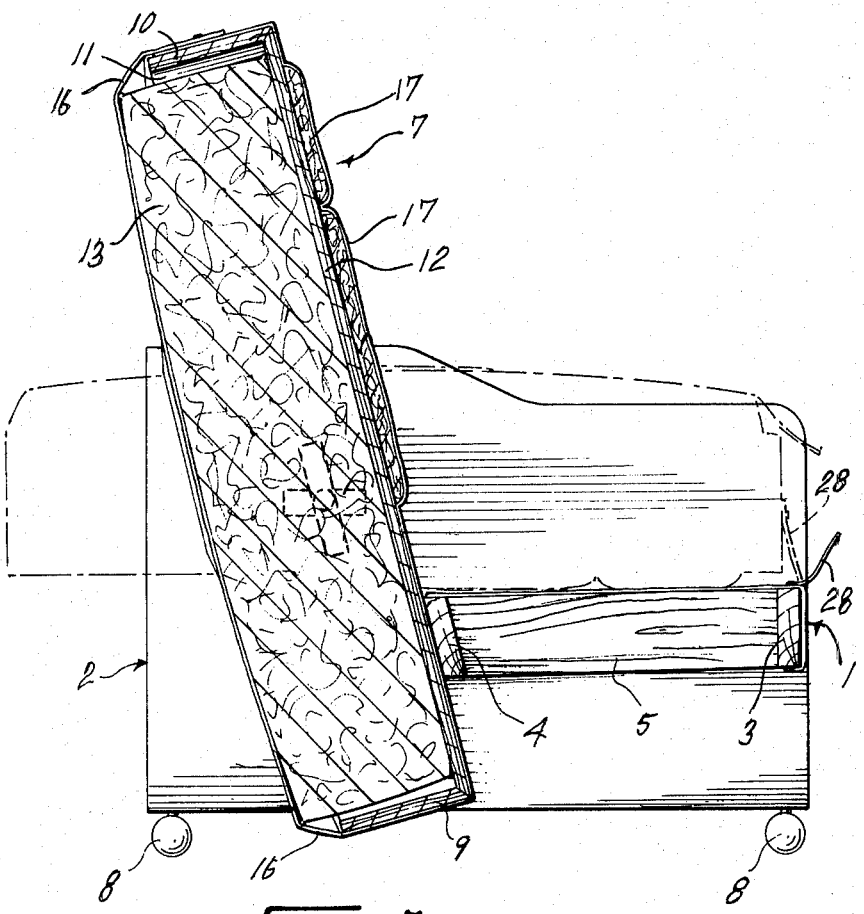
FIG. 5 is a cross-sectional view of the sofa-bed as seen along line 5—5 in FIG. 1.

When the sofa-bed is in the sofa configuration, the unit abuts in rearwardly inclined position against the inclined board 4, as shown in FIG. 5.

Figure 2:
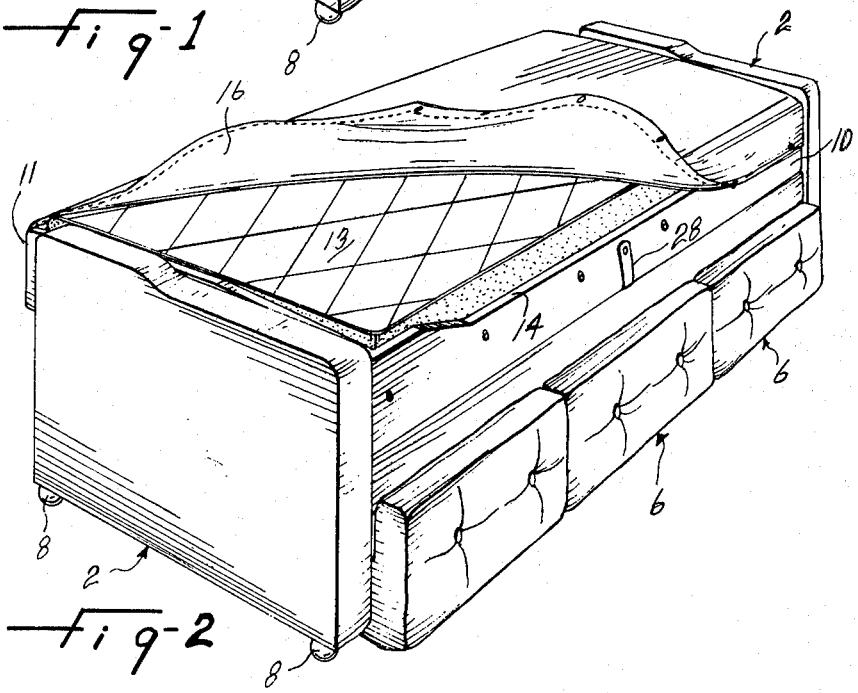
FIG. 2 is a perspective view of the same sofa-bed shown in the bed configuration position.
Figure 4:
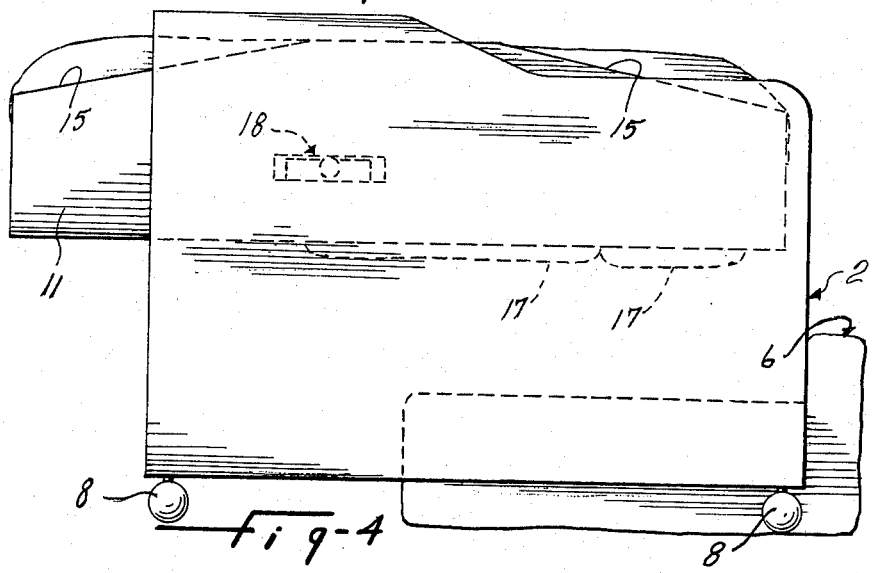
FIG. 4 is an end view of the sofa-bed shown in the bed configuration position.

When the sofa-bed is in the bed configuration, as shown in FIGS. 2 and 4, the paddings 17 abut against the top of the base 1 to relieve the weight or force on the pivot pins 26. A strap 28 fixed to the front board 4 is snapped to the unit 7 to prevent tilting of the latter and falling of the user on the floor if he happens to concentrate his weight on the overhanging edge portion of the unit.

What I claim is:

1. A sofa-bed comprising a base having a top seating portion, a pair of opposite end structures fixedly secured to the opposite ends respectively of the base and upwardly projecting therefrom, a backrest-bed unit having a box-shaped periperal frame construction and a rigid panel fixed to the peripheral frame construction and cooperatively forming therewith a rectangular cavity within the peripheral frame construction, a mattress removably mounted in said rectangular cavity, and a pair of single pivot connections pivotally connecting the backrest-bed unit to the opposite end structures at the opposite ends respectively of said unit and defining a single pivot axis extending above said base, each of said single-pivot connections including a pair of pivot members, one of said pivot members constitutes a plate rigidly secured to one of said opposite end structures and having a central portion bulging away from the corresponding opposite end structure and having a slot therein inwardly extending downward from the top edge thereof and constituting a pivot recess and the other of said pivot members rigidly secured to the end of said backrest-bed unit and including a pivot pin projecting endwise relative to said backrest unit and laterally engageable and pivotable into the slot of the corresponding one pivot member.

2. A sofa-bed as defined in claim 1, wherein said single pivot axis is inwardly spaced relative to the opposite faces and the opposite lateral edges defined by the box-shaped backrest-bed unit in balancing relationship relative to the latter.

3. A sofa-bed as defined in claim 1, wherein said backrest-bed unit includes a flexible cover sheet detachably securable transversely over the rectangular cavity and operatively holding blankets in position against the mattress and the blankets and mattress in position within said cavity.

4. A sofa-bed as defined in claim 3, wherein backrest padding is secured against said rigid panel on the opposite side respective to said rectangular cavity and to said mattress, said opposite end structures, forming armrests for said sofa-bed in the sofa configuration position and a strap operatively connects said base to said backrest-bed unit when the latter is pivoted to the bed configuration position.

* * * * *